US007861527B2

(12) United States Patent
Xu

(10) Patent No.: US 7,861,527 B2
(45) Date of Patent: Jan. 4, 2011

(54) REHEATER TEMPERATURE CONTROL

(75) Inventor: Bin Xu, Atlanta, GA (US)

(73) Assignee: Doosan Babcock Energy America LLC, Atlanta, GA (US)

( * ) Notice: Subject to any disclaimer, the term of this patent is extended or adjusted under 35 U.S.C. 154(b) by 218 days.

(21) Appl. No.: 12/074,701

(22) Filed: Mar. 5, 2008

(65) Prior Publication Data

US 2009/0223224 A1 Sep. 10, 2009

(51) Int. Cl.
*F01K 7/34* (2006.01)

(52) U.S. Cl. ..... 60/653; 60/679; 60/680

(58) Field of Classification Search ..... 60/653, 60/679, 680

See application file for complete search history.

(56) References Cited

U.S. PATENT DOCUMENTS 3,105,357 A * 10/1963 Vogler ..... 60/676
3,886,749 A * 6/1975 Pacault ..... 60/652
4,003,786 A * 1/1977 Cahn ..... 376/322
4,896,496 A * 1/1990 Zervos ..... 60/772
2007/0199300 A1 * 8/2007 MacAdam et al. ..... 60/39.52

FOREIGN PATENT DOCUMENTS

WO WO 95/24822 9/1995

* cited by examiner

*Primary Examiner*—Hoang M Nguyen

(57) ABSTRACT

A thermal power generation apparatus comprises a boiler (15) and multiple turbine sets for high, intermediate and lower steam pressure operation. Steam exhausted from the high pressure turbine (HP), and reduced in both pressure and temperature, is returned to a reheater (19) for reheating. The reheated steam is then passed to a intermediate pressure turbine (IP). It is desirable to control the temperature of steam entering the intermediate pressure turbine (IP). The invention provides a system for effecting temperature control of the reheater stream in a thermal power plant. The system includes a reheater conduit (10, 21) adapted to define at least a part of a reheat flow path for steam between an exhaust of a high pressure turbine system (HP) and an inlet of a reheater system (19). The system further includes an indirect water/steam heat exchanger (B) having a heat exchange portion within the reheat flow path and defining a water flow path means adapted to receive and circulate feed water. The feed water may be taken from take off points (A, D) in the primary feed water stream.

16 Claims, 3 Drawing Sheets

REHEATER TEMPERATURE CONTROL

The invention relates to a system and method for effecting temperature control of the reheater stream in a thermal power plant or the like.

A typical thermal power generation apparatus comprises multiple turbine sets, and usually three turbine sets for high, intermediate and lower steam pressure operation. Steam exhausted from the high pressure turbine, and reduced in both pressure and temperature, is returned to a reheater for reheating. The reheated steam is then passed to the intermediate pressure turbine. It is desirable to control the temperature of steam entering the intermediate pressure turbine.

Boiler steam temperature can be controlled by one or more of several methods. These include the following:

- the damper control of gases to the superheater, to the reheater, or to both, thus changing the heat pickup duties (PBE control);
- the recirculation of low-temperature flue gas to the furnace, thus changing the relative amounts of heat absorbed in the furnace and in the superheater, reheater, or both (FGR control);
- the selective use of burners at different elevations in the furnace or the use of tilting burners, thus changing the location of the combustion zone with respect to the furnace heat-absorbing surface;
- the control of the firing rate in divided furnaces;
- the control of the firing rate relative to the pumping rate of the feedwater to forced-flow once-through boilers;
- the attemperation, by the injection of spray water (i.e. spray control);
- the attemperation, by by-passing partial cold reheat steam;
- the attemperation, by the passage of a portion of the steam through a heat exchanger submerged in the boiler water.

The last three techniques in particular are used in prior art systems for the attemperation of steam in the reheater stream as it passes from the high pressure system to the reheater.

It is desirable to develop a system and method for reheater steam attemperation that balances effective temperature control with the avoidance or mitigation of excessive thermal cycle efficiency losses. It is desirable to develop an approach that can be used for retrofitting existing boilers as well as new plant designs.

According to the invention in a first aspect a system for effecting temperature control of the reheater stream in a thermal power plant or the like comprises:

- a reheater conduit adapted to define at least a part of a reheat flow path for steam between an exhaust of a high pressure turbine system and an inlet of a reheater system;
- an indirect water/steam heat exchanger having a heat exchange portion within the reheat flow path and defining a water flow path means adapted to receive and circulate feed water.

The underlying principle of the invention is therefore the attemperation of the reheat stream by employing an indirect contact steam/water heat exchanger in the reheat stream which cools the reheat stream (either fully or partially) using feed water from the feed water stock which is bypassed from a primary water feed stream, passed through the heat exchanger, and then passed back to the primary water feed stream downstream of the take off point but upstream of, and for example directly upstream of, the boiler. Where applicable the feed water so used preferably bypasses, in whole or in part, any preheater system provided between the supply stock and the boiler. In order for the feed water to cool the reheat stream, it follows that the feed water received by the heat exchanger has a temperature lower than the temperature of the steam in the reheat stream.

This method of reheater attemperation, and the system by means of which the method is employed, provides smooth and responsive temperature control, for example comparable to that previously achieved by the injection of spray water directly into the reheat stream, but by an indirect contact system using an indirect heat exchanger. This can avoid a significant thermal efficiency penalty experienced in direct spray systems in particular.

In accordance with the system and method of the invention, intermediate pressure heat is transferred via the attemperation process to the high pressure stream and used for feed water preheating. This method results not only in the mitigation or elimination of a significant thermal efficiency penalty when compared with a direct spray system but also can reduce high pressure steam bleed in any associated high pressure feed water preheater, enhance the high pressure output, and improve cycle efficiency.

The system and method of the invention offer flexibility in application. Reheater attemperation control can be achieved by simply adjusting the bypassing feed water flow rate to the heat exchanger, or by varying the reheated steam flow in a by-pass, or both.

The system and method of the invention exhibit flexibility as regards incorporation into plant design. The heat exchanger can be designed and employed either externally to or internally to the primary reheat stream, and can be located upstream the cold reheater, inter-stage, or downstream the final hot reheater and still be effective. The system in accordance with the invention lends itself to incorporation into existing designs, and into existing plant in situ, as well as into new designs.

In familiar manner the indirect heat exchanger comprises:

- an inlet and an outlet disposed externally of a reheater conduit and a heat transfer portion defining a flow path means for feed water between the inlet and the outlet which is disposed at least in part within the reheater conduit, and so disposed in the reheater flow path, but fluidly isolated from the gas stream therein, and
- heat transfer means associated with the heat transfer portion for transferring heat from gas in the reheater conduit flow path to feed water in the flow path means of the heat exchanger.

The system may be incorporated directly internally into a primary reheater conduit and hence in a primary reheater flow path, or indirectly externally of a primary reheater conduit in a secondary external reheater conduit fluidly parallel to the primary reheater conduit and receiving a bypass reheater flow. The term "reheater conduit" will be understood in this context as referring to a conduit anywhere in the reheat stream, whether in the primary system or in a parallel, bypass system, whether comprising a reheater pipe, header or any other conduit means.

Preferably the flow path means of the heat exchanger comprises a flow path conduit and for example a tubular conduit defining an inlet and an outlet disposed externally of a reheater conduit and passing through the reheater conduit.

Preferably the heat transfer portion comprises heat transfer surfaces disposed in a gas flow path of the reheater conduit and conductively coupled via the flow path means to feed water in the flow path means in use. For example the heat transfer means comprise heat transfer surfaces. Heat transfer surfaces may comprise walls of a flow path conduit making up the heat exchange portion. Additionally or alternatively the heat exchange portion may comprise further heat transfer surfaces extending outwardly from and in thermally conductive contact with and for example formed integrally with a flow path conduit. The heat exchanger is preferably a tubular heat exchanger, the heat exchange portion comprising a plurality of tubes. Conveniently, at least in some applications, the heat transfer portion comprises further heat transfer surfaces extending outwardly from the tube(s).

In a first possible embodiment the apparatus of the invention is provided internally to a primary reheater conduit. Preferably in this embodiment the heat exchanger comprises a condensing shell tube heat exchanger. Alternatively the apparatus may be provided externally to the primary reheater conduit. It may be provided in a bypass reheater conduit fluidly parallel to the primary reheater conduit.

In a second possible embodiment the apparatus of the invention is provided externally to a primary reheater conduit in a bypass reheater conduit fluidly parallel thereto. Preferably in this embodiment the heat exchanger comprises a finned tube formation, preferably comprising a plurality of longitudinal finned tubes, conveniently a bundle of parallel finned tubes. A suitable valve means in the primary conduit diverts reheat flow via the bypass in familiar manner. Alternatively the apparatus may be provided internally to the primary reheater conduit.

In a more complete apparatus embodying the principles of the invention, a system as hereinabove described is incorporated into a steam generation apparatus such as a boiler apparatus that might be incorporated into a thermal power plant, the steam generation apparatus having a steam generator, a feed water supply stock to supply feed water for steam generation, and feed water flow path defining means to define a flow path for feed water from the supply stock to steam generator.

An inlet of the system as hereinabove described is fluidly connected to receive feed water from a feed water stock, an outlet of a system as hereinabove described is fluidly connected to deliver feed water to a steam generator, the system of the invention thus being connected fluidly in parallel to the main feed water supply flow path, and in a preferred embodiment to bypass and substitute for the action of some or all of any preheaters provided in such a primary feed water supply flow path between the feed water stock and the steam generator.

In a more complete system, a steam turbine generation apparatus comprises, connected fluidly in series in familiar manner via suitable flow path defining conduits:

- a feed water supply,
- a preheater apparatus,
- a steam generator such as a boiler or the like,
- a super heater apparatus,
- a high pressure turbine set,
- a reheater apparatus,
- a reheater conduit defining at least in part a reheat flow path for steam between an exhaust of the high pressure turbine set and an inlet of the reheater apparatus,
- an intermediate pressure turbine set and a low pressure turbine set, wherein there is provided fluidly connected between the feed water supply and the steam generator, in parallel to and bypassing at least in part the preheater apparatus, an attemperation system comprising:
- an indirect water/steam heat exchanger having a heat exchange portion within the reheat flow path and defining a water flow path means adapted to receive and circulate feed water.

Such steam generator/superheater/reheater arrangements will be familiar to the person skilled in the art, and the precise design or arrangement is not specifically pertinent to the invention, which is in intended to be suitable to a wide variety of thermal power generation apparatus designs, both as a pre- and as a post-design adaptation.

According to the invention in a further aspect a method for effecting temperature control of the reheater stream in a thermal power plant or the like comprises:

- taking feed water from a primary feed water stream;
- passing feed water through an indirect water/steam heat exchanger disposed within a reheat flow path for steam between an exhaust of a high pressure turbine system and an inlet of a reheater system;
- thereby attemperating steam in the reheat flow path;
- passing feed water from an outlet of the indirect water/steam heat exchanger back to a primary feed water stream.

Thus, in accordance with the method of the invention, a proportion of feed water is bypassed from the primary feed water stream and taken through an indirect heat exchange apparatus disposed within a reheat flow path, being either a primary or a bypass flow path, carrying steam between a high pressure set and a boiler reheater in familiar manner. Steam attemperation is effected with the advantages set out above. A feed water stream is passed back, at an elevated temperature, to the primary feed water stream, for example downstream of any preheater, and for example immediately upstream of the boiler system.

In accordance with the method, intermediate pressure heat is transferred to the high pressure stream and used to effect feed water preheating with the advantages set out above. Hence, the feed water bypassed from the primary stream in accordance with the method of the invention conveniently bypasses some or all of the reheater apparatus which will typically be present, the method for example comprising taking feed water from the primary feed water stream upstream of a reheater apparatus, and passing feed water from an outlet of the indirect water steam heat exchanger back to a primary feed water system downstream of a preheater apparatus.

Other advantages of the method will be understood by analogy with the discussion of the advantages of the system here and above.

The invention will now be described by way of example only with reference to FIGS. 1-3 of the accompanying drawings wherein:

FIG. 1 illustrates diagrammatically part of a thermal generation unit, including feed water tank, preheaters, boiler with superheater and reheater, high pressure and intermediate pressure turbine sets. The essentially conventional apparatus will be discussed first.

Figure 1:
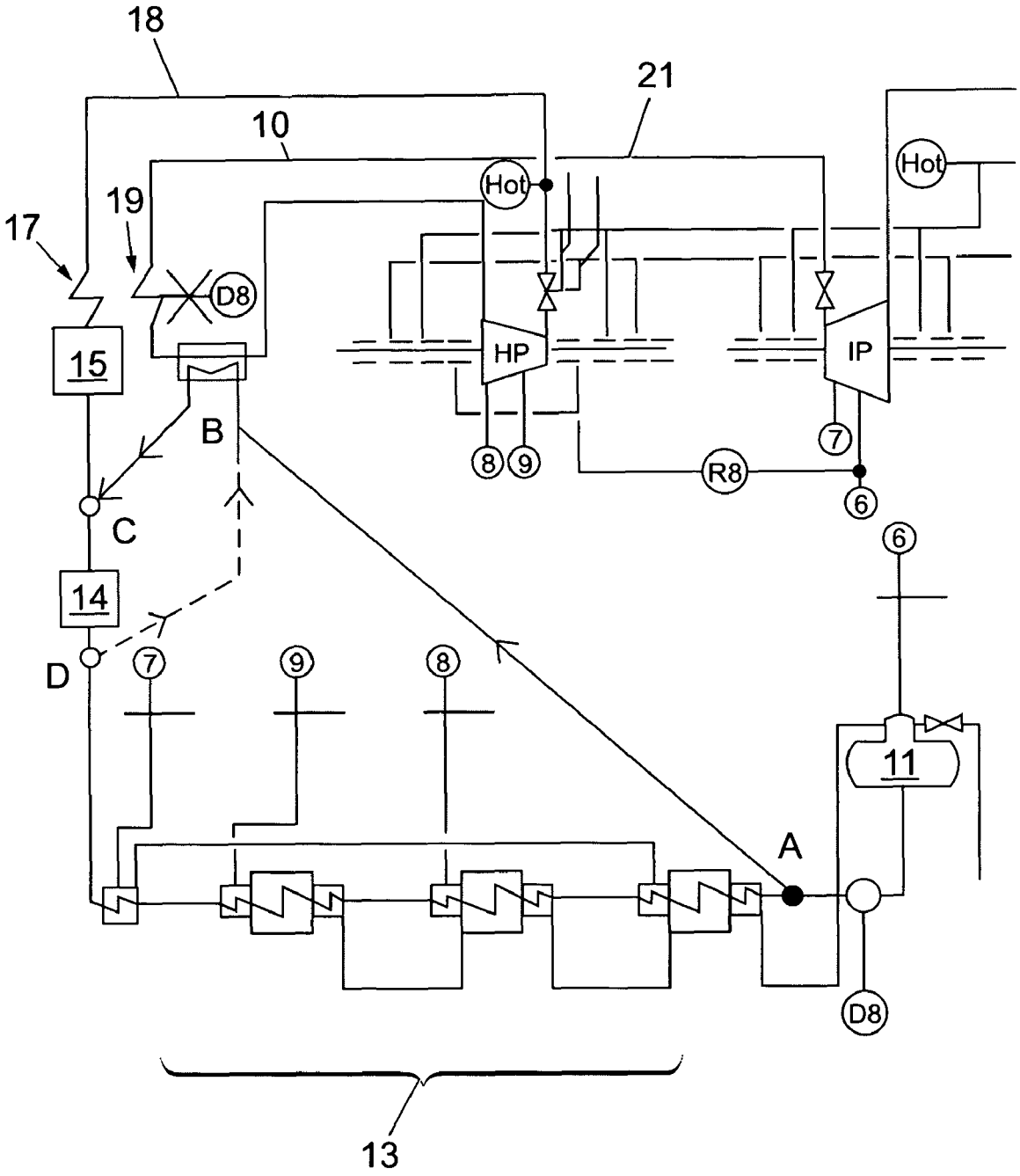
FIG. 1 is a simplified diagrammatic view of a part of a thermal power generation apparatus incorporating a system in accordance with the invention.

Primary feed water from a feed water tank 11 is passed via a succession of preheaters 13 and an optional economiser 14 to a steam generator boiler 15. The boiler is shown entirely schematically, but will include in familiar manner suitable combustion apparatus to burn fuel from a suitable fuel supply (neither shown) and thus provide the heat necessary to generate steam from the feed water stock. The steam is passed through superheater 17 via high pressure pipes/headers 18 to a high pressure turbine set HP.

Exhaust from the high pressure turbine set is passed via reheat pipes and headers 10 to a reheater 19, and then via intermediate pressure pipes/headers 21 to an intermediate pressure turbine set IP and subsequently to a low pressure turbine set (not shown). Such a general apparatus will be familiar.

The apparatus varies from such a conventional arrangement in accordance with the method of the invention in that a portion of the feed water is bypassed upstream of the boiler 15 and fed instead to an indirect heat exchanger in the reheat stream 10, 21 between the high pressure turbine set HP and the intermediate pressure turbine set IP. This is illustrated entirely schematically in FIG. 1, which merely identifies a suitable point for take off of feed water A upstream of the preheater set 13, a de-superheater heat exchanger B illustrated purely schematically in this figure, and an indicative location for feed water return C immediately upstream of the boiler 15. By way of example, instead of using a take off point A upstream of the preheater set 13, it is possible to use a take off point D upstream of the optional economiser 14 and downstream of the preheater set 13. The feed path from the take off point D is shown as a dashed line in FIG. 1.

In accordance with the method and system of the invention steam temperature attemperation is achieved by indirect steam/water contact in the heat exchanger disposed within the reheat conduit 10, 21 between intermediate pressure steam from the HP set and feed water within pipes in the heat exchanger, which de-superheats the steam in the reheat stream. In the embodiment, the heat exchanger B is shown upstream of the reheater 19. This is one possible configuration only. The heat exchanger can for example be located upstream of cold reheat, at an intermediate stage, or downstream of hot reheat.

The resultant heated feed water leaves the heat exchanger and is returned to the main feed water stream. The heated feed water return location C is also indicative. Return is preferably downstream of the preheater set, since the heat exchanger B preheats feed water in parallel. Feed water return is upstream of the boiler, and for example may be at an economiser inlet or outlet header.

A significant advantage of the system of the invention is that it offers flexibility in design. For example, optimised selection of feed water take off location A, heat exchanger location B and feed water return location C might be determined by considerations of where interlink pipework and the like can be minimised, as well as by thermal operational considerations.

Figure 2:
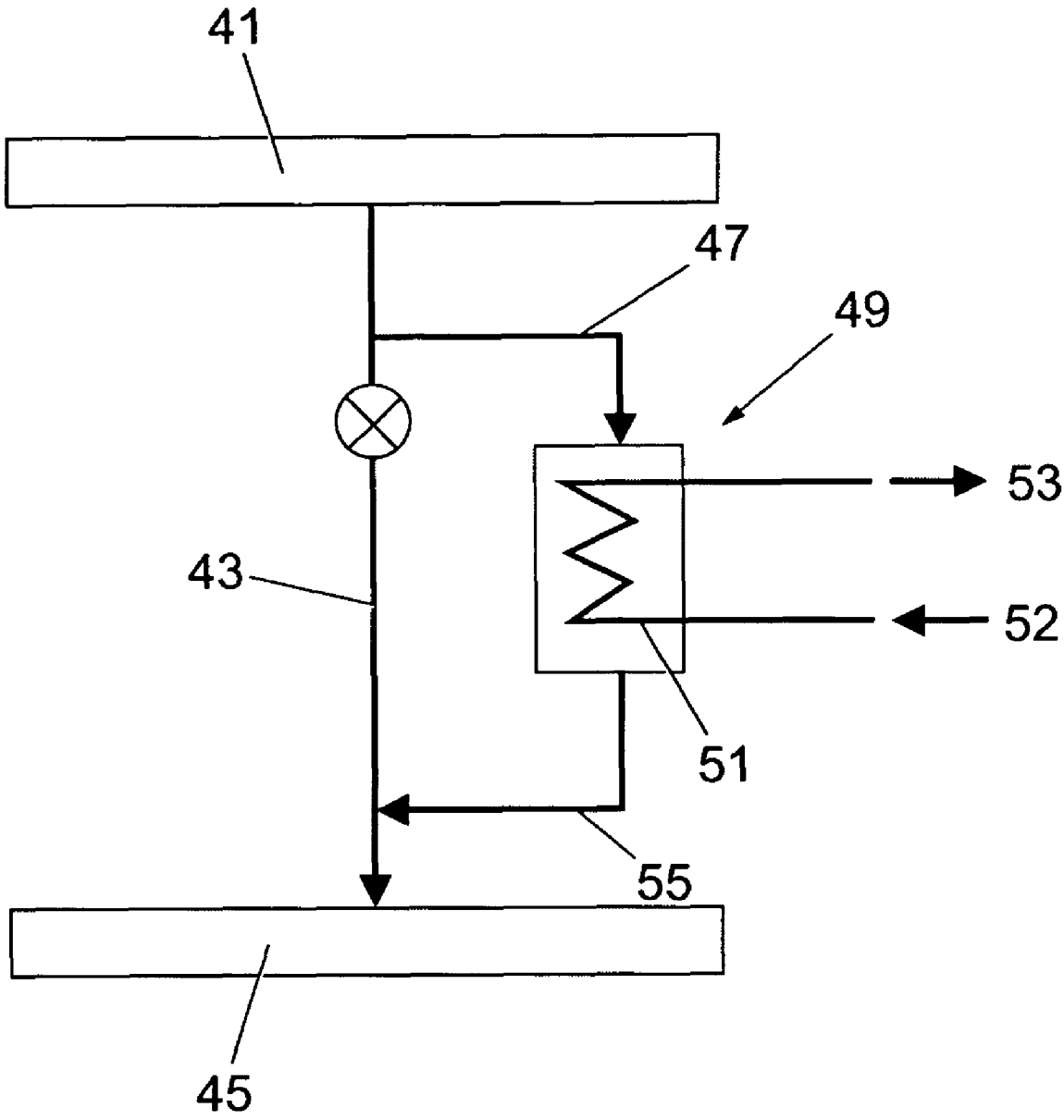
FIG. 2 is a general schematic of a first arrangement of heat exchanger in accordance with the invention.

A possible heat exchanger arrangement in accordance with the invention is illustrated in FIG. 2. This illustrates an external design in which a heat exchanger is provided in a bypass stream external to the main reheat stream.

Referring to FIG. 2, HP exhaust 41 passes via primary reheater conduits 43 to a reheater inlet header 45, which may for example be a primary or second inter-stage reheater inlet header depending upon the desired location of the heat exchanger of the invention. A proportion of the flow is selectively bypassed using suitable valve means via a reheater flow bypass conduit 47 into a heat exchanger 49. The heat exchanger may be a conventional condensing heat exchanger, for example similar in design to a conventional feed water preheater, comprising a condensing shell tube type heat exchanger 51 with feed water on the tube side and passing through the tubes via the inlet 52 and outlet 53 and steam on the shell side. De-superheated steam is passed back to the primary reheat stream 43 via conduit 55.

Figure 3:
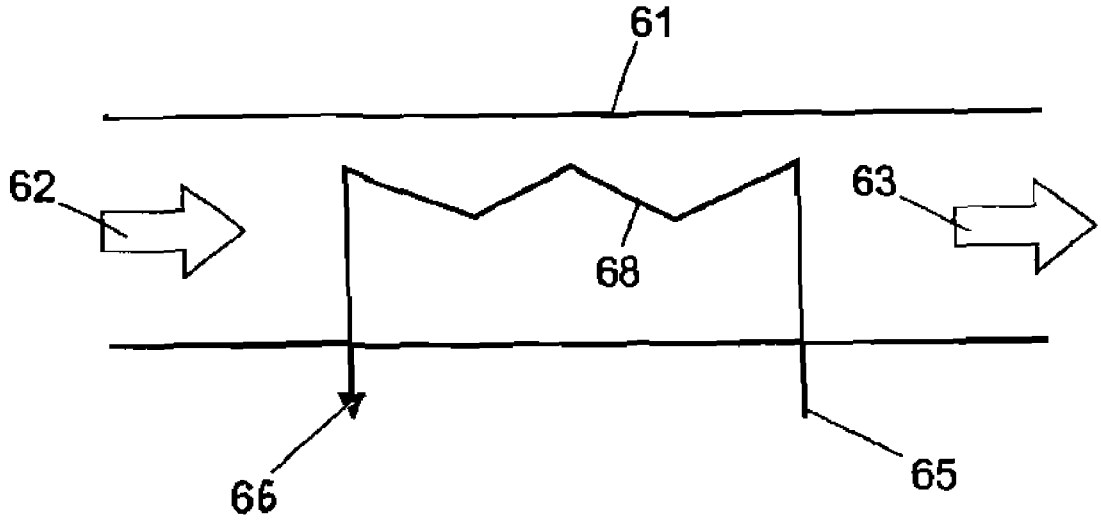
FIG. 3 is a general schematic of a second arrangement of heat exchanger in accordance with the invention.

An alternative embodiment of heat exchanger for use in accordance with the method of the invention directly in the primary reheat stream is illustrated in FIG. 3.

In FIG. 3, the primary reheat steam pipe 61 is shown with a RH steam inlet 62 to receive steam exhausted from the HP set and a RH steam outlet 63 to pass steam on towards the reheater apparatus. An indirect steam/water heat exchanger receives feed water via a feed water inlet 65 and passes it out via a feed water outlet 66 having passed through heat exchanger elements 68 and effected a de-superheating of steam in the reheat stream. The heat exchanger elements are integrated directly within the reheater conduit 61, which can be the main reheater steam pipe, inter-stage pipe or header depending on the selected location of the heat exchanger. The heat exchanger elements 68 preferably comprise a bundle of parallel longitudinally finned tubes.

In accordance with the invention, a method and system are developed for reheater steam control which can be flexibly applied to a range of boiler designs, both in original design and as modification to existing design, for example in situ, in order to control the reheater steam temperature in variable control load range without the requirement for conventional FGR or water spray methodologies.

The proposed method exhibits smooth temperature control characteristics with the potential to improve thermal cycle efficiency, avoiding a number of the cycle efficiency penalties suffered by other alternative methods.

The method and system of the invention achieve control of the reheater outlet and thus of the inlet temperature of the intermediate pressure turbine set IP. The heat exchanger B can be controlled by varying or controlling the steam flow or water flow or both.

The invention claimed is:

1. A system for effecting temperature control of the reheater stream in a thermal power plant comprising:

a reheater conduit adapted to define at least a part of a reheat flow path for reheat steam between an exhaust of a high pressure turbine system and an inlet of a reheater system; and an indirect water/steam heat exchanger having a heat exchange portion within the reheat flow path and defining a water flow path means adapted to receive and circulate feed water having a temperature lower than the temperature of the reheat steam, the heat exchanger causing heat to be transferred from the reheat steam in the reheat flow path to the feed water, wherein the heat exchanger is provided externally to a primary reheater conduit in a bypass reheater conduit fluidly parallel thereto.

2. A system according to claim 1 wherein the heat exchanger comprises:

an inlet and an outlet disposed externally of the reheater conduit and a heat transfer portion defining the flow path means for feed water between the inlet and the outlet which is disposed at least in part within the reheater conduit, and so disposed in the reheat flow path, but fluidly isolated from the reheat steam therein, and heat transfer means associated with the heat transfer portion for transferring heat from the reheat steam in the reheat flow path to the feed water in the flow path means of the heat exchanger.

3. A system according to claim 2 wherein the flow path means of the heat exchanger comprises a tubular flow path conduit defining the inlet and the outlet disposed externally of the reheater conduit and passing through the reheater conduit.

4. A system according to claim 2 wherein the heat transfer portion comprises heat transfer surfaces disposed in the reheat flow path of the reheater conduit and conductively coupled via the flow path means to feed water in the flow path means in use.

5. A system according to claim 4 wherein the heat transfer surfaces comprise walls of a flow path conduit defining the flow path means.

6. A system according to claim 5 wherein the heat transfer portion comprises further heat transfer surfaces extending outwardly from and in thermally conductive contact with the flow path conduit.

7. A system according to claim 2 wherein the heat exchanger is a tubular heat exchanger, the heat transfer portion comprising a plurality of tubes.

8. A system for effecting temperature control of the reheater stream in a thermal power plant comprising:

a reheater conduit adapted to define at least a part of a reheat flow path for steam between an exhaust of a high pressure turbine system and an inlet of a reheater system; and an indirect water/steam heat exchanger having a heat exchange portion within the reheat flow path and defining a water flow path means adapted to receive and circulate feed water, wherein the heat exchanger is provided externally to a primary reheater conduit in a bypass reheater conduit fluidly parallel thereto.

9. A system according to claim 8 wherein the heat exchanger comprises a finned tube formation.

10. A system according to claim 9 wherein the heat exchanger comprises a plurality of longitudinal finned tubes.

11. A system according to claim 10 wherein the heat exchanger comprises a bundle of parallel finned tubes.

12. A system according to claim 1 incorporated into a steam generation apparatus having a steam generator, a feed water supply stock to supply feed water for steam generation, and feed water flow path defining means to define a flow path for feed water from the supply stock to the steam generator;

an inlet of the system being fluidly connected to receive feed water from the feed water stock at a temperature lower than the temperature of the reheat steam, an outlet of the system being fluidly connected to deliver the feed water, that has been heated due to heat being transferred thereto from the reheat steam, to the steam generator, the system thus being connected fluidly in parallel to the feed water flow path defining means.

13. A steam turbine generation apparatus comprising, connected fluidly in series via flow path defining conduits:

a feed water supply, a preheater apparatus, a steam generator, such as a boiler, receiving a feed water stream;

a super heater apparatus, a high pressure turbine set, a reheater apparatus, a reheater conduit defining at least in part a reheat flow path for reheat steam between an exhaust of the high pressure turbine set and an inlet of the reheater apparatus, an intermediate pressure turbine set and a low pressure turbine set, wherein there is provided fluidly connected between the feed water supply and the steam generator, in parallel to and bypassing at least in part the preheater apparatus, an attemperation system comprising:

an indirect water/steam heat exchanger having a heat exchange portion within the reheat flow path and defining a water flow path means adapted to receive and circulate feed water having a temperature lower than the temperature of the reheat steam, the heat exchanger causing heat to be transferred from the reheat steam in the reheat flow path to the feed water, and an outlet fluidly connected to deliver the feed water, that has been heated due to heat being transferred thereto from the reheat steam, to the feed water stream.

14. A method for effecting temperature control of the reheater stream in a thermal power plant, comprising:

taking a portion of feed water from a primary feed water stream;

supplying the portion of feed water at a temperature lower than the temperature of the reheat steam of the reheater stream to an indirect water/steam heat exchanger disposed within a reheat flow path for the reheat steam between an exhaust of a high pressure turbine system and an inlet of a reheater system;

passing the feed water through the heat exchanger;

thereby attemperating steam in the reheat flow path by transferring heat from the reheat steam to the feed water; and passing the feed water from an outlet of the indirect water/steam heat exchanger back to the primary feed water stream.

15. The method of claim 14 wherein the heat exchanger is provided internally to a primary reheater conduit for the reheat steam in the reheat flow path, and the step of passing includes causing the feed water to flow in the indirect water/steam heat exchanger disposed within the reheat flow path.

16. The method of claim 14 wherein the heat exchanger is provided externally to a primary reheater conduit for the reheat steam in the reheat flow path, in that a bypass reheater conduit is provided fluidly parallel thereto, and the step of passing includes diverting at least a proportion of the reheat steam from the primary reheat flow path into a parallel reheat flow path defined by the bypass reheater conduit, and causing the feed water to flow in the indirect water/steam heat exchanger disposed within the parallel reheat flow path.

* * * * *